US006820755B1

(12) United States Patent
Ranjit

(10) Patent No.: US 6,820,755 B1
(45) Date of Patent: Nov. 23, 2004

(54) BEAUTY AND HAIR ACCESSORIES ORGANIZER

(76) Inventor: Mike P. Ranjit, 236 Pin Oak Rd., Freehold, NJ (US) 07728

( * ) Notice: Subject to any disclaimer, the term of this patent is extended or adjusted under 35 U.S.C. 154(b) by 8 days.

(21) Appl. No.: 10/136,628

(22) Filed: May 2, 2002

(51) Int. Cl.[7] ..... A47F 7/00; A47F 5/08; B65D 1/36

(52) U.S. Cl. ..... 211/70.6; 211/88.01; 206/564; 206/804

(58) Field of Search ..... 211/70.6, 87.01, 211/88.01; D6/553, 566, 524; 206/38, 6.1, 385, 564, 566, 581, 804, 576

(56) References Cited

U.S. PATENT DOCUMENTS 1,492,381 A * 4/1924 Lindenmayer ..... 206/38
2,458,020 A * 1/1949 Olsen ..... 206/385
3,684,102 A * 8/1972 Colter ..... 211/88.01
4,121,600 A * 10/1978 Riddick et al. ..... 206/581
4,140,222 A * 2/1979 Francavilla ..... 211/65
4,305,512 A * 12/1981 Mackenzie ..... 211/75
D301,101 S * 5/1989 Meyer ..... D6/553
5,320,263 A * 6/1994 Kobylack ..... 206/817
D365,481 S * 12/1995 McKeon ..... D6/513
D385,136 S * 10/1997 Gutke ..... D6/524
5,813,549 A * 9/1998 Sheehan et al. ..... 211/87.01
D454,460 S * 3/2002 Davies ..... D6/566

* cited by examiner

*Primary Examiner*—Daniel P. Stodola
*Assistant Examiner*—Erica B. Harris

(57) ABSTRACT

A beauty and hair accessories organizer for holding and neatly storing hair managing tools and beauty aids. The beauty and hair accessories organizer includes a support member having a front side and a back side and being adapted to be mounted to a structure in a building; and also includes a storage rack member being securely attached to the front side of the support member; and further includes a plurality of cup-like members being attached to the storage rack for supporting and holding hair managing items.

1 Claim, 4 Drawing Sheets

BEAUTY AND HAIR ACCESSORIES ORGANIZER

BACKGROUND OF THE INVENTION

1. Field of the Invention

The present invention relates to health care products organizers and more particularly pertains to a new beauty and hair accessories organizer for holding and neatly storing hair managing tools and beauty aids.

2. Description of the Prior Art

The use of health care products organizers is known in the prior art. More specifically, health care products organizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,485,931; U.S. Pat. No. 5,054,615; U.S. Pat. No. 5,727,701; U.S. Pat. No. Des. 438,674; U.S. Pat. No. Des. 418,947; and U.S. Pat. No. 5,630,517.

While these devices fulfill their respective, particular objectives and requirements, the aforementioned patents do not disclose a new beauty and hair accessories organizer. The prior art includes inventions having support members with holders attached to the support members and being adapted to receive and hold various health care products.

SUMMARY OF THE INVENTION

The general purpose of the present invention, which will be described subsequently in greater detail, is to provide a new beauty and hair accessories organizer which has many of the advantages of the health care products organizers mentioned heretofore and many novel features that result in a new beauty and hair accessories organizer which is not anticipated, rendered obvious, suggested, or even implied by any of the prior art health care products organizers, either alone or in any combination thereof. The present invention includes a support member having a front side and a back side and being adapted to be mounted to a structure in a building; and also includes a storage rack member being securely attached to the front side of the support member; and further includes a plurality of cup-like members being attached to the storage rack for supporting and holding hair managing items. None of the prior art describes a storage rack member having a plurality of openings therein to effectively aerate the storage compartments.

There has thus been outlined, rather broadly, the more important features of the beauty and hair accessories organizer in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new beauty and hair accessories organizer which has many of the advantages of the health care products organizers mentioned heretofore and many novel features that result in a new beauty and hair accessories organizer which is not anticipated, rendered obvious, suggested, or even implied by any of the prior art health care products organizers, either alone or in any combination thereof.

Still another object of the present invention is to provide a new beauty and hair accessories organizer for holding and neatly storing hair managing tools and beauty aids.

Still yet another object of the present invention is to provide a new beauty and hair accessories organizer that is easy and convenient to set up and use.

Even still another object of the present invention is to provide a new beauty and hair accessories organizer that reduces the possibility of the beauty products being lost and also keeps the tops of counters neat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
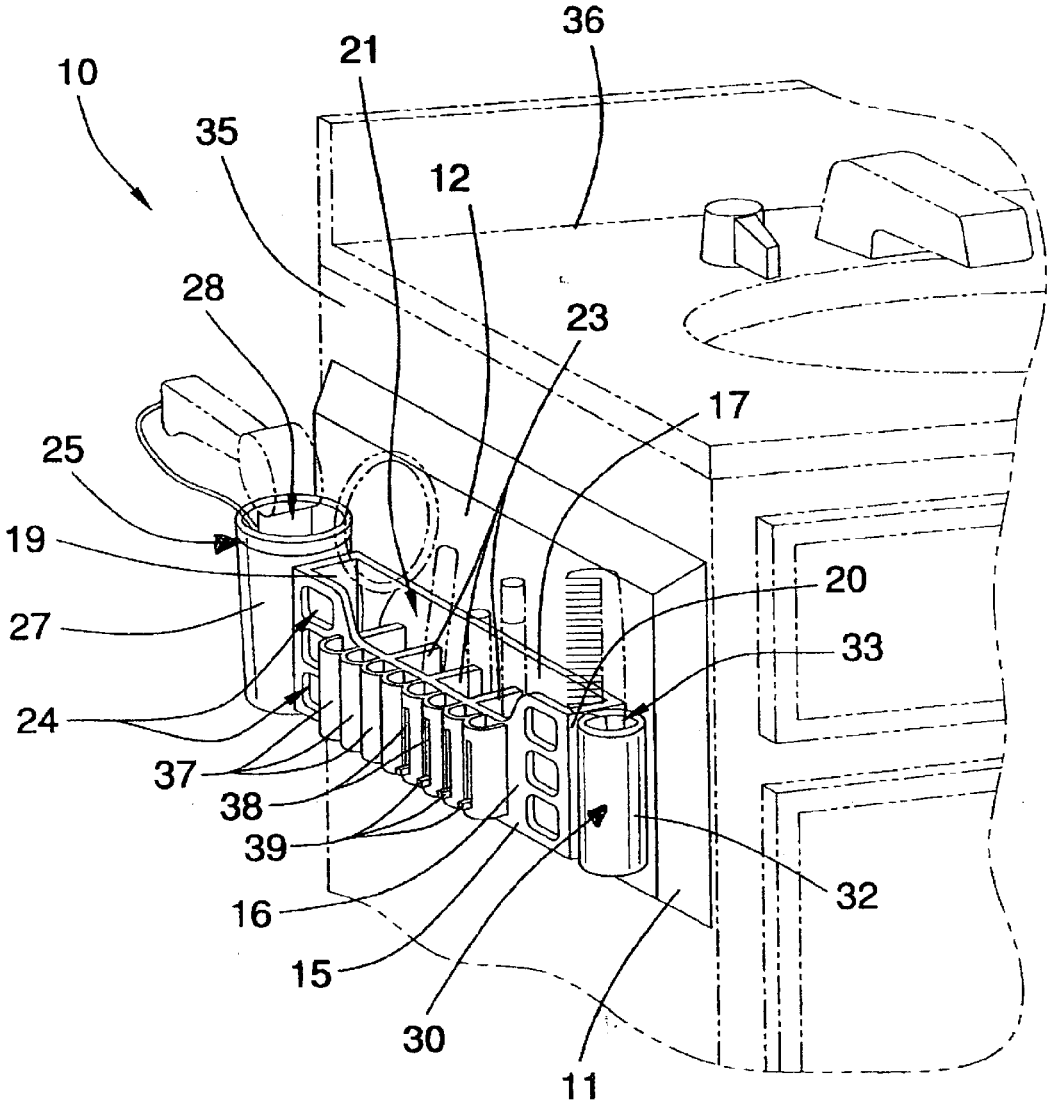
FIG. 1 is a perspective view of a new beauty and hair accessories organizer according to the present invention and shown in use.

With reference now to the drawings, a new beauty and hair accessories organizer embodying the principles and concepts of the present invention and generally designated by the reference numeral 10 will be described.

Figure 2:
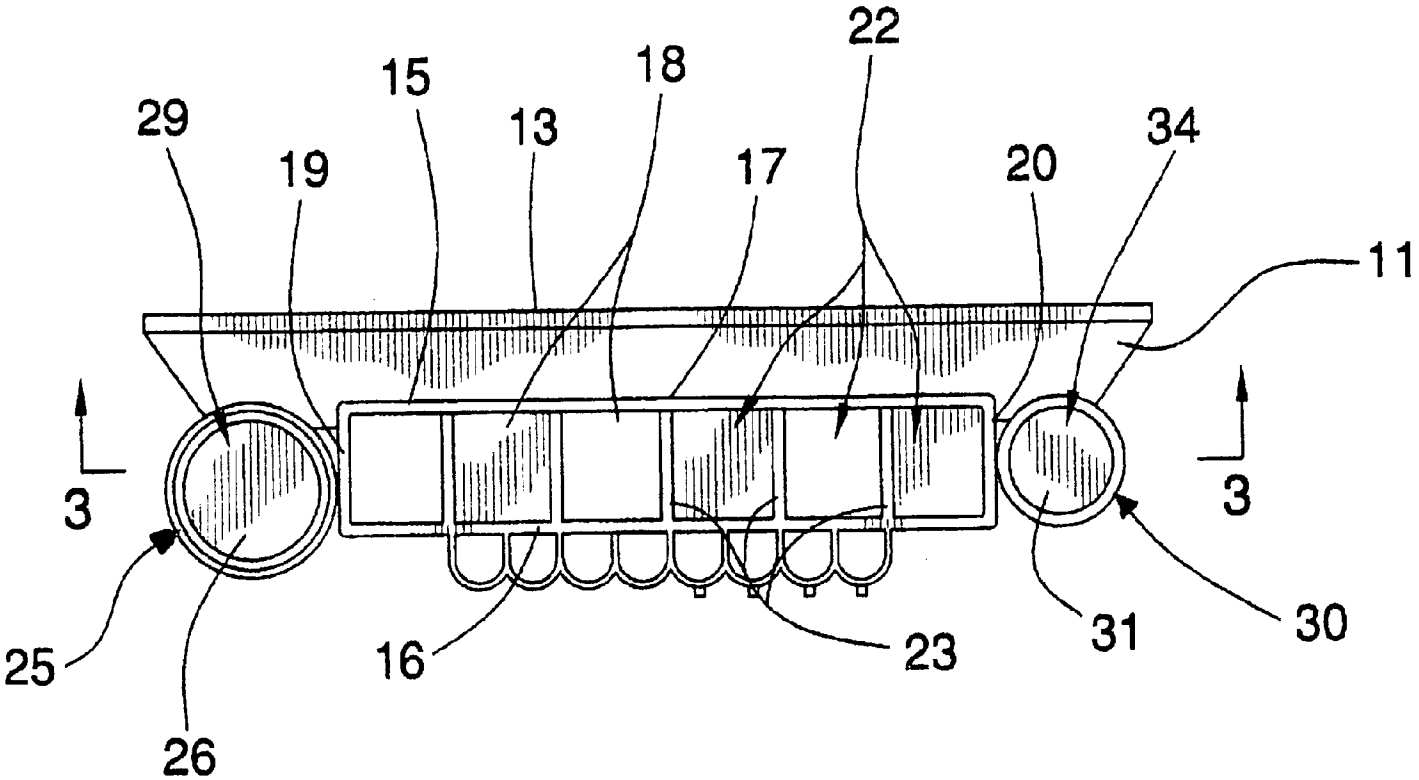
FIG. 2 is a top plan view of the present invention.
Figure 3:
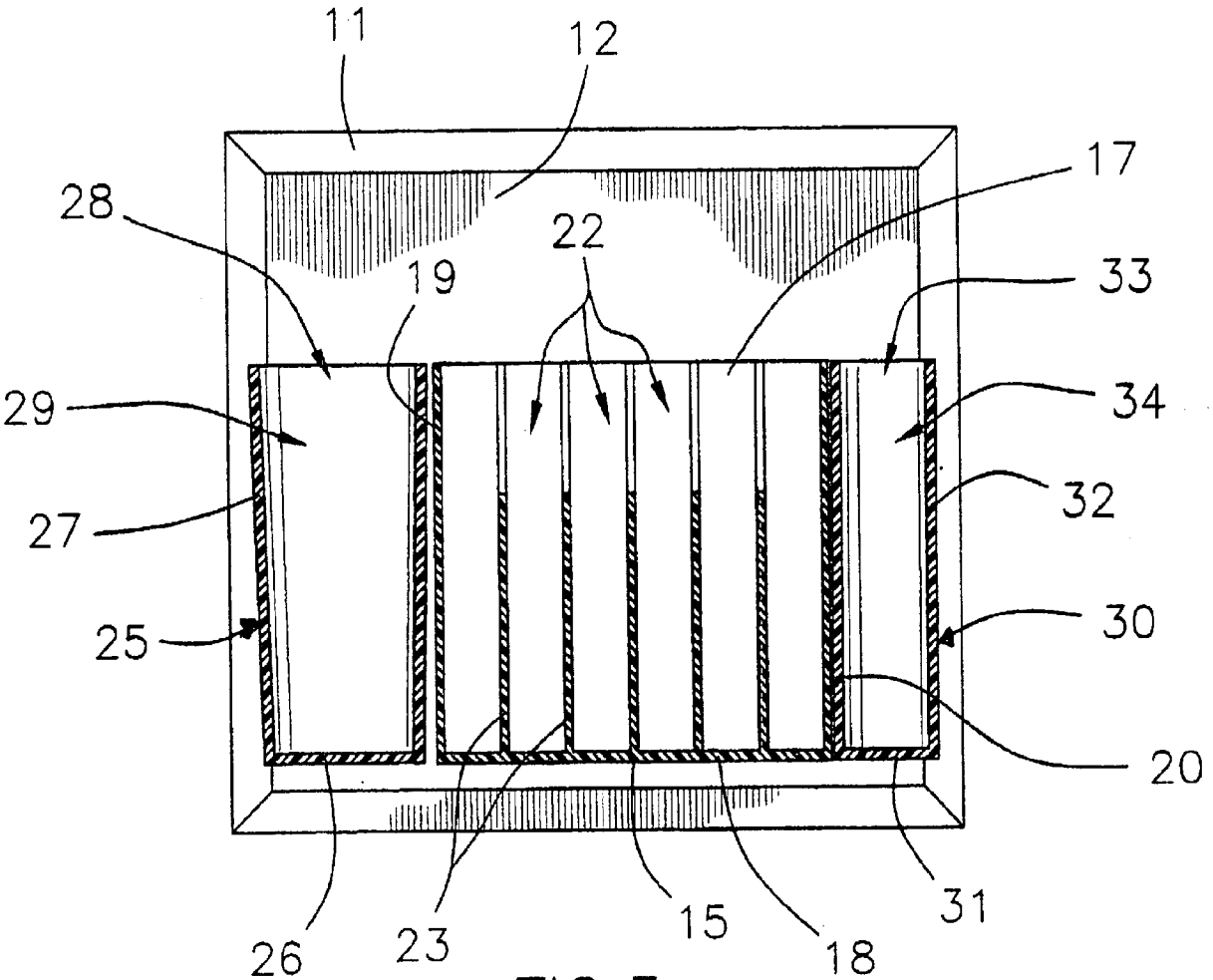
FIG. 3 is a longitudinal cross-sectional view of the present invention.
Figure 4:
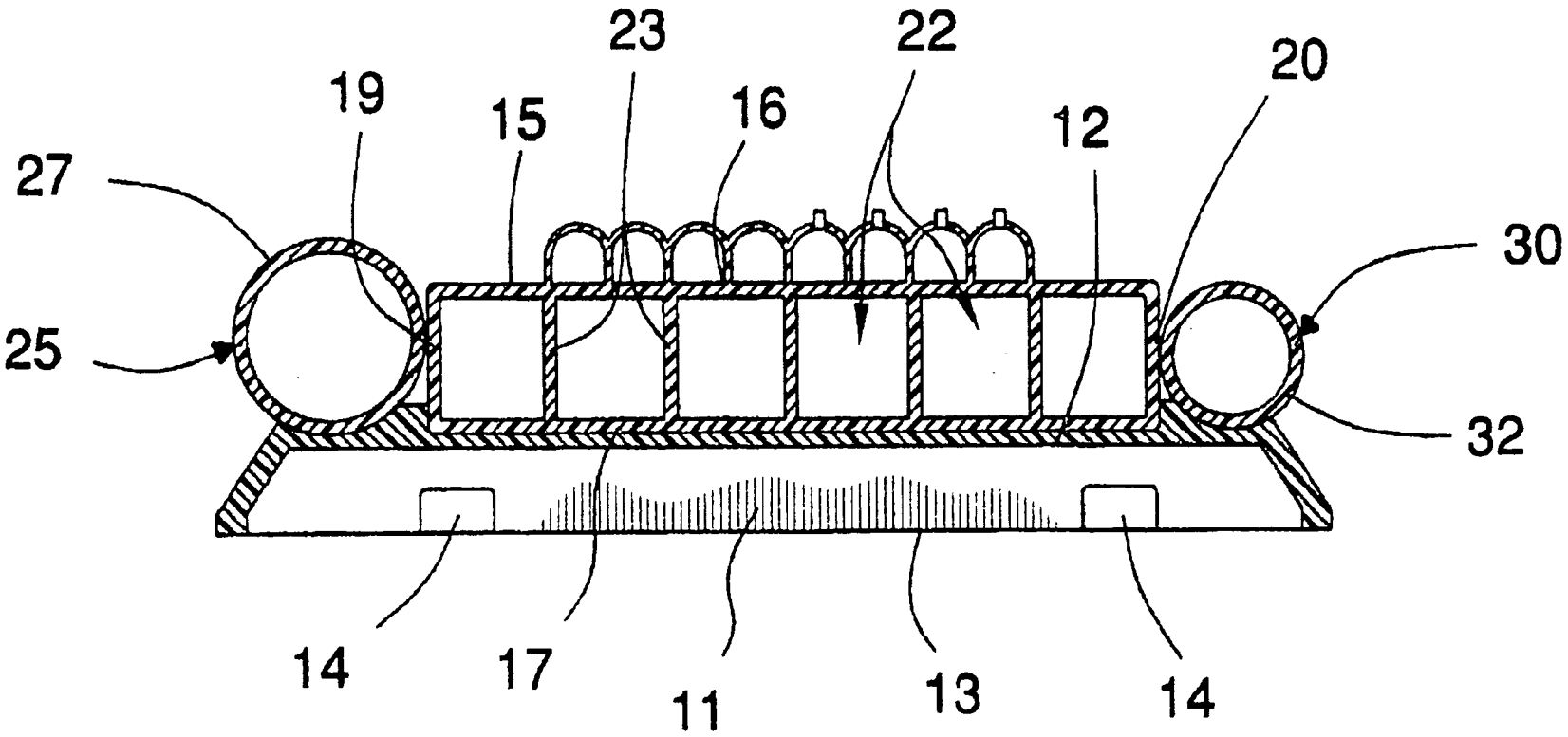
FIG. 4 is a lateral cross-sectional view of the present invention.

As illustrated in FIGS. 1 through 4, the beauty and hair accessories organizer 10 generally comprises a support member 11 having a front side 12 and a back side 13 and being adapted to be securely mounted to a structure 36 in a building. The support member 11 is generally a board member having a definite thickness with the back side 13 having a greater surface area than the front side 12. The back side 13 of the support member 11 is adapted to securely mount with brackets 14 to a wall 35 of the structure 36 in the building.

A storage rack member 15 is securely and conventionally attached and glued to the front side 12 of the support member 11. The storage rack member 15 includes front, back, bottom, and side walls 16–20, and also includes an open top 21, and further includes a plurality of storage compartments 22 being separated by partitions 23 which conventionally interconnect the front and back walls 16,17. The storage rack member 15 also includes a plurality of pocket members 37 being conventionally attached side-by-side and being securely attached to an exterior of the front wall 16 for storing cosmetic accessories such as lip sticks, nail files, tweezers, and eye pencils with the pocket members 37 having longitudinal slots 38 being disposed through a wall thereof. The front wall 16 also has a top edge which has a centrally-disposed recessed portion to allow easy access to accessories stored in the storage compartments 22. Also, levers 39 are movably and conventionally disposed in the pocket members 37 through the longitudinal slots 38 to urge the cosmetic accessories to the open top of the pocket members 37.

A plurality of cup members 25,30 are securely and conventionally attached and glued to the storage rack member 15 for supporting and holding hair managing items. The plurality of cup members 25,30 are securely and conventionally attached to exteriors of the side walls 19,20 of the storage rack member 15. The plurality of cup members 25,30 are generally cylinders having side and bottom walls 26,27,31,32 and also having an open top 28,33 with a storage compartment 29,34 disposed therein. The plurality of cup members 25,30 includes a first cup member 25 which is securely and conventionally attached to one side of the storage rack member 15, and also includes a second cup member 30 which is securely and conventionally attached to the other side of the storage rack member 15 and which has a length and circumference generally smaller than that of the first cup member 25.

In use, the user would generally place one's beauty products in the storage compartments 22 of the storage rack member 15, and would place one's hair dryer in the first cup member 25, and would place either a comb or a curling iron in the second cup member 30. When needed, the user would simply remove the items from either the storage rack member 15 or the cup members 25,30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the beauty and hair accessories organizer. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beauty and hair accessories organizer comprising:

a support member having a front side and a back side and being adapted to be mounted to a structure in a building, said support member being generally a board member having a definite thickness with said back side having a greater surface area than said front side;

a storage rack member being securely attached to said front side of said support member, said storage rack member including front, back, bottom, and side walls defining an open top, and further including a plurality of storage compartments being separated by partitions which interconnect said front and back walls, said storage rack member also including a plurality of pocket members being attached side-by-side and being securely attached to an exterior of said front wall for storing cosmetic accessories including lip sticks, nail files, tweezers, and eye pencil with each of said pocket members having a longitudinal slot being disposed through a wall thereof, said front wall also having a top edge which has a centrally-disposed recessed portion to allow easy access to accessories stored in said storage compartments, said storage rack member further includes levers being movably disposed in said pocket members through said longitudinal slots to urge the cosmetic accessories to the open top of said pocket members; and a plurality of cup members being attached to said storage rack member for supporting and holding hair managing items.

* * * * *